US011818828B2

(12) United States Patent
Tao et al.

(10) Patent No.: US 11,818,828 B2
(45) Date of Patent: Nov. 14, 2023

(54) POWER MANAGEMENT SYSTEM OF MOBILE X-RAY MACHINE AND CONTROL METHOD THEREOF

(71) Applicant: Delta Electronics (Shanghai) CO., LTD, Shanghai (CN)

(72) Inventors: Yao Tao, Shanghai (CN); Hongyuan Jin, Shanghai (CN); Chang She, Shanghai (CN); Tianwei Wang, Shanghai (CN); Xintian Li, Shanghai (CN)

(73) Assignee: Delta Electronics (Shanghai) CO., LTD, Shanghai (CN)

( * ) Notice: Subject to any disclaimer, the term of this patent is extended or adjusted under 35 U.S.C. 154(b) by 265 days.

(21) Appl. No.: 17/319,351

(22) Filed: May 13, 2021

(65) Prior Publication Data

US 2021/0368610 A1 Nov. 25, 2021

(30) Foreign Application Priority Data

May 20, 2020 (CN) ..... 202010431552.3

(51) Int. Cl.
*H05G 1/32* (2006.01)
*H05G 1/54* (2006.01)

(52) U.S. Cl.
CPC ..... *H05G 1/32* (2013.01); *H05G 1/54* (2013.01)

(58) Field of Classification Search
CPC ..... H05G 1/10; H05G 1/32
See application file for complete search history.

(56) References Cited

U.S. PATENT DOCUMENTS 4,540,930 A * 9/1985 Siedband ..... H05G 1/24 378/102
2011/0050403 A1* 3/2011 Liu ..... G06F 1/3206 340/384.1
2011/0135063 A1* 6/2011 Gonda ..... A61B 6/56 378/98.5

(Continued)

FOREIGN PATENT DOCUMENTS

JP 2005304696 A 11/2005
JP 2010252890 A 11/2010

(Continued)

OTHER PUBLICATIONS

Notice of Reasons for Refusal dated May 16, 2022 of Japan Patent Application No. 2021-085382.

*Primary Examiner* — Chih-Cheng Kao
(74) *Attorney, Agent, or Firm* — Qinghong Xu

(57) ABSTRACT

The embodiments of the present disclosure provide a power management system of a mobile X-ray machine and a control method thereof. The power management system comprises a power module group; a main control module being connected with a upper machine, and configured to receive an action signal sent by the upper machine, acquire status information of the power module group, and output a control signal; a functional component power pack being connected with the power module group and the main control module, and configured to convert electrical energy of the power module group according to the control signal and output converted energy to a functional component of a high-voltage generator.

19 Claims, 4 Drawing Sheets

(56) References Cited

U.S. PATENT DOCUMENTS

| | | | | |
|---|---|---|---|---|
| 2011/0186741 | A1* | 8/2011 | Ohta | A61B 6/4233<br>250/370.08 |
| 2013/0223596 | A1* | 8/2013 | Kojima | H05G 1/12<br>378/102 |
| 2013/0279661 | A1* | 10/2013 | Tamura | A61B 6/42<br>378/114 |
| 2016/0089102 | A1* | 3/2016 | Wang | A61B 6/40<br>378/62 |

FOREIGN PATENT DOCUMENTS

| | | | | |
|---|---|---|---|---|
| JP | 2011131089 | A | | 7/2011 |
| JP | 2013254573 | A | | 12/2013 |
| JP | 2018015080 | A | | 2/2018 |
| JP | 2019024815 | A | * | 2/2019 |
| JP | 2019024815 | A | | 2/2019 |
| WO | 2012067171 | A1 | | 5/2012 |
| WO | 2019082299 | A1 | | 5/2019 |

* cited by examiner

POWER MANAGEMENT SYSTEM OF MOBILE X-RAY MACHINE AND CONTROL METHOD THEREOF

CROSS-REFERENCE TO RELATED APPLICATIONS

This application is based upon and claims priority to Chinese Patent Application No. CN 202010431552.3, filed on May 20, 2020, the entire content of which is incorporated herein by reference.

TECHNICAL FIELD

The present disclosure relates to the technical field of power electronics, in particular to a power management system of a mobile X-ray machine and a control method thereof.

BACKGROUND

With the rapid development of modern medical X-ray machine, the mobile X-ray machines can be used for bedside photo diagnosis for patients, outdoor diagnosis, and rural regions without suitable power distribution due to its flexible mobility and independent on external power distribution, thereby it has been vigorously promoted and its market demand is increasing.

In the X-ray machines, a high-voltage generator is an important constituent part. The high-voltage generator contains a power module group with electrical energy storage function. The high-voltage generator needs to be used for a long time after being charged, so it is necessary to allocate and manage internal electrical energy scientifically and reasonably, so as to reduce electrical energy loss and achieve optimal energy saving requirements.

It should be noted that the information disclosed in the above background section is only used to enhance the understanding of the background of the present disclosure, and therefore may include information that does not constitute prior art known to those of ordinary skill in the art.

SUMMARY

An object of the present disclosure is to provide a power management system of a mobile X-ray machine and a control method thereof, so as to reduce the power consumption of the mobile X-ray machine at least to a certain extent.

According to a first aspect of the present disclosure, a power management system of a mobile X-ray machine is provided. The power management system includes a power module group; a main control module being connected with an upper machine, and configured to receive an action signal sent by the upper machine, acquire status information of the power module group, and output a control signal; a functional component power pack being connected with the power module group and the main control module, and is configured to convert electrical energy of the power module group according to the control signal and output converted energy to functional components.

According to a second aspect of the present disclosure, a control method for the power management system of the mobile X-ray machine according to the first aspect is provided. The power management system includes: a power module group; a main control module being connected with an upper machine; and a functional component power pack being connected with the power module group and the main control module. The control method includes: powering on a main control module according to an action signal sent by an upper machine; and generating a control signal according to the action signal sent by the upper machine, and controlling a functional component power pack to convert electrical energy of the power module group and output converted energy to functional components.

It should be noted that the information disclosed in the background art section above is only used to enhance the understanding of the background of the present disclosure, and therefore may include information that does not constitute the prior art known to those of ordinary skill in the art.

BRIEF DESCRIPTION OF THE DRAWINGS

The drawings herein are incorporated into and constitute a part of the specification. The drawings show embodiments consistent with the present application, and are used to explain the principles of the application together with the specification. By reading and referring to the following detailed description of the non-limiting embodiments made by the drawings, other features, objects and advantages of the present disclosure will become more obvious. Obviously, the drawings in the following description are only some embodiments of the present disclosure. For those of ordinary skill in the art, without paying any creative work, other drawings can be obtained based on these drawings.

DETAILED DESCRIPTION

Figure 1:
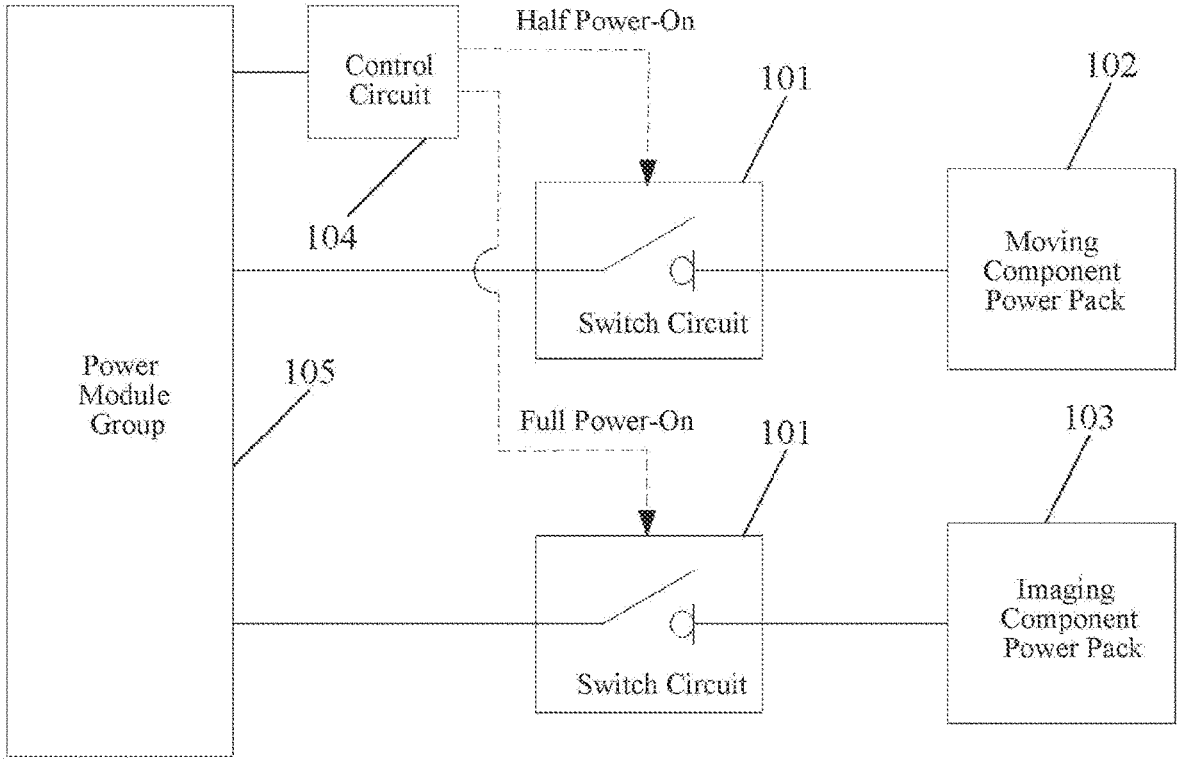
FIG. 1 shows a schematic diagram of a power supply structure for a mobile X-ray machine in the prior art.

Example embodiments will now be described more fully with reference to the drawings. However, the example embodiments can be implemented in various forms, and should not be construed as being limited to the examples set forth herein; on the contrary, providing these embodiments makes the disclosure more comprehensive and complete, and fully conveys the concept of the example embodiments to those skilled in the art. The described features, structures, or characteristics may be combined in one or more embodiments in any suitable manner.

In addition, the features, structures, or characteristics described above may be combined in any suitable manner in one or more embodiments. In the description below, numerous specific details are set forth to provide a thorough understanding of the embodiments of the present disclosure. However, those skilled in the art will appreciate that the technical solution of the present disclosure may be practiced without one or more of the specific details, or other methods, components, apparatus, steps and the like may be employed. In other instances, well-known methods, apparatus, implements or operations are not shown or described in detail to avoid obscuring various aspects of the present disclosure.

Some of the block diagrams shown in the figures are functional entities and do not necessarily correspond to physically or logically separate entities. These functional entities may be implemented in software, or implemented in one or more hardware modules or integrated circuits, or implemented in different networks and/or processor devices and/or microcontroller devices.

Flowcharts shown in the drawings are only exemplary illustrations, and it is not necessary to include all contents and operations/steps, or to be executed in an order described. For example, some of the operations/steps can also be decomposed, and some of the operations/steps can be merged or partially merged, so an order of actual execution may change according to actual situations.

In power management system of the mobile X-ray machine of the related art, power management is performed by switching on and off respective power modules in a time-sharing manner via a mechanical switch such as a relay. This solution has disadvantages such as large power loss and so on.

As shown in FIG. 1, in the prior art, in generally, mobile high-voltage generator includes a switch set 101 with mechanical switches such as a relay and the like, to switch on and off respective power modules (i.e. a moving component power pack 102 and an imaging component power pack 103) in a time-sharing manner, so as to perform power manage. The switch set 101 is connected between a power module group 105 and different power packs, and is controlled by a control circuit 104. Mechanical switches such as a relay and the like set in a power circuit are relatively large in size and have a limited number of operations. Therefore, the mobile high-voltage generators in the prior art have the problems of service life, which affect the reliability of the entire product and cannot meet increasingly stringent medical requirements.

With more and more functions of mobile X-ray machines, high-voltage generators have more operating states. The function is single which only realizes power management through relays and the like. Moreover, for the considerations of cost and reliability, it is generally not desirable to add a mechanical switch such as a relay to each power module inside the high-voltage generator, which can't provide flexibly control for each power module to achieve the best energy saving effect. In addition, when the mobile X-ray machine is shutdown, the control circuit cannot be cut off, so the power loss is large during a long time standby.

In summary, how to reduce the power loss of the X-ray machine and achieve better power management is a technical problem that needs to be solved urgently. The embodiments of the present disclosure provide a power management system used for a mobile X-ray machine and a control method thereof, so as to reduce the power loss of the mobile X-ray machine and achieve better power management.

Figure 2:
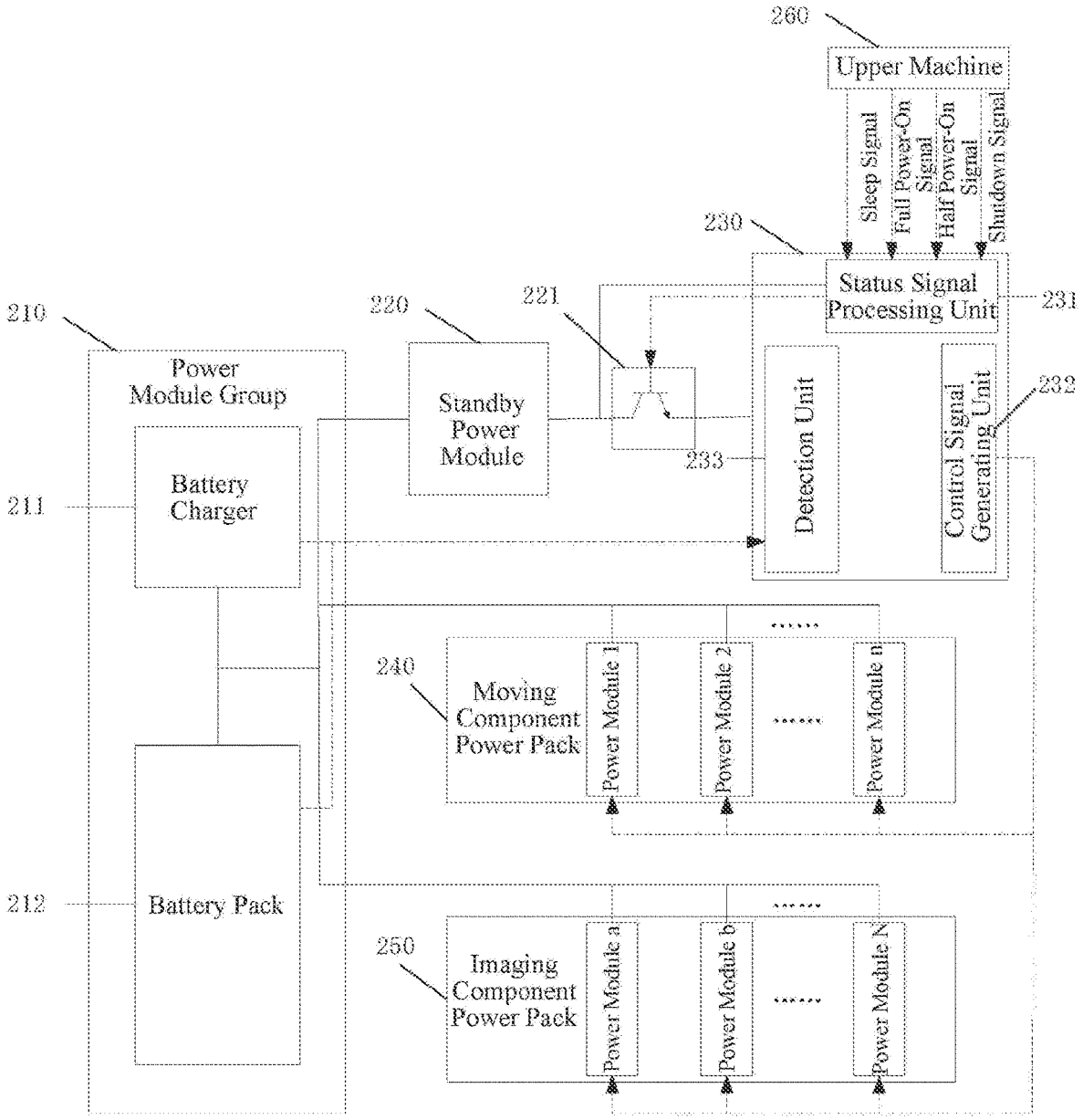
FIG. 2 shows a power management architecture diagram of a mobile X-ray machine system according to an embodiment of the present disclosure.

As shown in FIG. 2, an embodiment of the present disclosure provides a power management system used for an X-ray machine. The power management system includes a power module group 210, a main control module 230, and a function component power pack. The main control module 230 is connected to a upper machine 260, and receives an action signal sent by the upper machine 260, acquires status information of the power module group 210, and then output a control signal. The function component power pack includes a moving component power pack 240 and an imaging component power pack 250. The moving component power pack 240 and the imaging component power pack 250 are respectively connected with the power module group 210 and the main control module 230 and are configured to output converted energy to respective functional components of the mobile X-ray machine, according to the control signal.

In the power management system used for mobile X-ray machine of the embodiments of the present disclosure, the main control module 230 optimizes power management according to instructions of the upper machine 260 and state of the power module group 210, and the main control module 230 can independently control switch-on and switch-off of each sub-power module in the functional component power pack. The main control module 230 adopts a fully digital power management scheme, which improves scientificity, reliability, flexibility and scalability of power management.

Specifically, the power management system of the mobile X-ray machine in embodiments of the present disclosure removes all switch set with mechanical switches to control the power modules of the functional component power pack, and the power modules of the functional component power pack is totally controlled by the control signal of the main control module. Therefore, the reliability and life of the mobile X-ray machine are improved.

The power module group 210 may include a battery pack 212 and a battery charger 211. Generally, the battery charger 211 is connected to a power grid and receives voltage of the power grid to charge the battery pack 212. The battery pack 212 may be a set of or more sets of battery module group. The status information of the power module group 210 may include battery charging status information, battery non-charging status information, battery power status information, and battery abnormal status information.

Among them, the battery charging status information refers to information in the case of the battery is being charged, including battery output voltage and charging current. The battery non-charging status information refers to information when the battery is being discharged, including battery output voltage and discharging current. The battery power status information includes state of charge (SOC). The battery abnormal status information includes whether the battery is working normally, whether there is overvoltage protection, undervoltage protection, overcurrent protection, overcharge protection, overdischarge protection, and overtemperature protection.

The power management system of the mobile X-ray machine not only performs power management according to an action signal received from the upper machine, but also makes a corresponding adjustment according to the status of the power module group. For example, in the power management scheme of the power management system used for the mobile X-ray machine in the embodiments of the present disclosure, an operation mode of the power management system used for the mobile X-ray machine is adjusted according to status information such as the charging status or discharging status of the power module group 210, the state of charge and so on, in order to make power management more scientific.

As shown in FIG. 2, the main control module 230 includes a status signal processing unit 231 and a control signal generating unit 232. The status signal processing unit 231 is electrically connected to the upper machine 260, receives an action signal sent by the upper machine 260 and sends it to the control signal generating unit 232. The control signal generating unit 232 generate and output a control signal according to the action signal.

In some embodiments, the action signal sent by the upper machine may include a sleep signal, a full power-on signal, a half power-on signal, and a shutdown signal.

As shown in FIG. 2, the power management system of the mobile X-ray machine according to the embodiments of the present disclosure further includes a standby power module 220, which is connected to the power module group 210 and the status signal processing unit 231, and is configured to convert electric energy of the power module group 210 and supply the converted energy to the status signal processing unit 231. Further, the standby power module 220 is electrically connected to the main control module 230 via a first switch 221. When the first switch 221 is turned on, the main control module 210 is powered by the standby power 220. The first switch 221 is turned on or turned off under control of the status signal processing unit 231. The first switch 221 may be a semiconductor switching device, such as IGBT, BJT, MOSFET, and is not limited thereto.

The embodiment of the present disclosure introduces a standby power module, which can be used for waking up the power management system of the mobile X-ray machine. When the power management system of the mobile X-ray machine is standby, only the standby power module works. The standby power module 220 supplies power to the status signal processing unit 231 to ensure that the status signal processing unit 231 can receive the action signal of the upper machine 260 at any time. The standby power module 220 will be connected to the main control module 220 through the first switch 221 only when receiving a power-on signal of the upper machine 260, and then the whole main control module 230 will be fully powered, which greatly reduces power loss of the power management system of the mobile X-ray machine during a long time standby, and increases utilization rate of battery energy.

In addition, in the embodiment of the present disclosure, the operation of each sub-power module in the power management system except for the standby power module 220 is independently controlled by the control signal generating unit 232 of the main control module 230, which improves the flexibility and expandability of the system.

Furthermore, the functional component power pack includes a moving component power pack 240 and an imaging component power pack 250. The moving component power pack 240 is connected with the power module group 210 and the main control module 230, and is configured to convert electrical energy of power module group 210 according to the control signal output by the control signal generating unit 232 and output a converted energy to a moving component of the mobile X-ray machine. The imaging component power pack 250 is connected with the power module group 210 and the main control module 230, and is configured to convert electrical energy of power module group 210 according to the control signal output by the control signal generating unit 232 and output a converted energy to an imaging component of the mobile X-ray machine.

The moving component power pack 240 includes several power modules for realizing movement function and movement-related functions of the mobile X-ray machine. The imaging component power pack 250 includes several power modules for realizing imaging function and imaging-related functions of the mobile X-ray machine. The upper machine 260 refers to a component of the mobile X-ray machine that controls a state of the power management system of the mobile X-ray machine. According to actual needs, the upper machine 260 sends a half power-on signal (start-up the moving function of the X-ray machine), a full power-on signal (start-up the moving function and the imaging function of the X-ray machine to ensure that the X-ray machine can work normally), a shutdown signal and a sleep signal to the power management system of the mobile X-ray machine.

Herein, the upper machine may be a timing control component of a mobile X-ray machine, and the timing control component may be a state switch knob used for mechanical switch-on or switch-off or a user operation software interface, and is not limited to this.

In addition, the main control module 230 further includes a detection unit 233 The detection unit 233 is connected with the power module group 210, and is configured to detect the status information of the power module group 210 and send the status information to the control signal generating unit 232. The control signal generating unit 232 generates the control signal based on the status information of the power module group 210 and the action signal sent by the upper machine 260.

The detection unit 233 detects state of the power module group 210 in real time. When the power of the battery pack 212 is insufficient and the battery charger 211 is not working yet, the main control module 230 will give a prompt that the system needs to be charged in time, and prohibit one or more power modules related to the imaging function of the mobile X-ray machine from working to avoid errors in patient diagnosis caused by insufficient supplying of the power module group 210. When the power of the battery pack 212 is insufficient and the battery charger 211 is working, the main control module 230 allows the one or more power modules related to the imaging function of the mobile X-ray machine to work, but limits its maximum output power. When the mobile X-ray machine is unable to diagnose the patient in time due to insufficient supplying, the main control module 230 will give a prompt to the user or operator that the system needs to be charged in time, and X-ray diagnosis function with normal dose can be restored by connecting to the grid.

Figure 3:
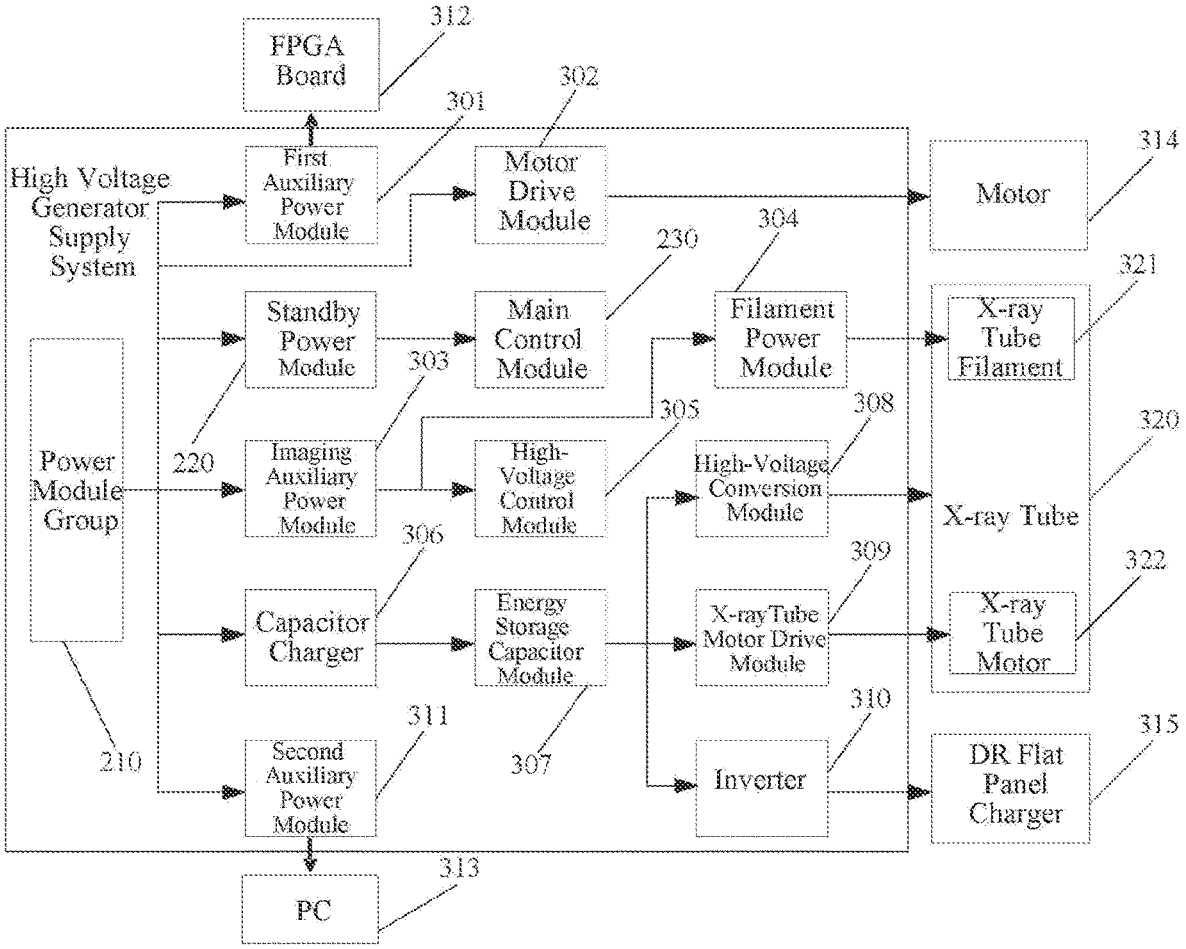
FIG. 3 shows an architecture diagram of a power management system of a mobile X-ray machine according to an embodiment of the present disclosure.

FIG. 3 shows an architecture diagram of a power management system of a mobile X-ray machine according to an embodiment of the present disclosure. As shown in FIG. 3, the moving component power pack includes at least any one of the following moving power modules; a first auxiliary power module 301 and a motor drive module 302. The imaging component power pack includes at least any of the following imaging power modules: an imaging auxiliary power module 303, a filament power module 304 connected to the imaging auxiliary power module 303, and a high-voltage control module 305 connected to the imaging auxiliary power module 303; a capacitor charger 306, an energy storage capacitor module 307 connected to the capacitor charger 306, a high-voltage conversion module 308 connected to the energy storage capacitor module 307, a X-ray tube motor drive module 309 connected to the energy storage capacitor module 307, and a inverter 310 connected to the energy storage capacitor module 307; and a second auxiliary power module 311. Wherein the moving power modules and the imaging power modules in this disclosure are not limited to this. In some embodiments, the motor drive module 302 mainly drives the X-ray machine to move, for example, so that the X-ray machine can be pushed and moved; in addition, the X-ray machine can also move up and down, for example, the up and down movement of the X-ray tube can be driven by the imaging auxiliary power module in the imaging component power pack, and is not limited to this.

The voltage provided by the first auxiliary power module 301 and the second auxiliary power module 311 can be 12V, 24V or 48V, and is not limited thereto.

For example, as shown in FIG. 3, the first auxiliary power module 301 provides power to the Field-Programmable Gate Array (FPGA) board 312, and the second auxiliary power module 311 provides power to a PC 313. The motor drive module 302 provides power to the motor 314. The high-voltage conversion module 308 provides power to the X-ray tube 320, the filament power module 304 provides power to a X-ray tube filament 321 of the X-ray tube 320, and the X-ray tube motor drive module 309 provides power to a X-ray tube motor 322 of the X-ray tube 320. The inverter 310 provides power to an DR flat panel charger 315. The present disclosure is not limited to this.

The embodiment of the present disclosure also provides a control method for a power management system of an X-ray machine. The control method includes powering on a main control module 230 according to an action signal sent by a upper machine 260; and, generating a control signal according to the action signal sent by the upper machine 260, and controlling a functional component power pack to convert electrical energy of a power module group and output the converted energy to a functional component of the mobile X-ray machine. Herein, the action signal sent by the upper machine 260 may be one or more of the following: a sleep signal, a full power-on signal, a half power-on signal, and a shutdown signal.

Further, status information of the power module group 210 is detected, and a control signal is generated according to the status information of the power module group 210 and the action signal sent by the upper machine 260, in order to control the moving component power pack 240 to convert electrical energy of the power module group 210 and output the converted energy to moving components of the high-voltage generator, and to control the imaging component power pack 250 to convert electrical energy of the power module group 210 and output the converted energy to imaging components of the high-voltage generator.

In some embodiments of the present disclosure, the control method further includes: determining an operation mode of the high-voltage generator according to the status information of the power module group 210 and the action signal sent by the upper machine 260, and generating a control signal according to the operating mode. The operation mode includes at least one of the following: a standby mode, a moving component power-on mode, an imaging component power-on mode, a sleep mode, a low battery reminder mode, a charging standby mode, a charging power-on mode, and a derating exposure mode (i.e., a reduced-power exposure mode). The standby mode refers to a state when the X-ray machine does not image and move but is ready for imaging and moving, and its power consumption is lower than the normal working state.

Furthermore, an operation mode of the high-voltage generators when the battery pack is in a charging state is not consistent with that in the case that the battery pack not in a charging state. The residual charge of battery also affects the operation mode of the high-voltage generator. Therefore, a corresponding control needs to be performed according to different battery states.

Firstly, when the battery pack is in a non-charging state, the operation mode of the high-voltage generator is determined according to the action signal.

In some embodiments, when the main control module 230 receives the shut-down signal, it can be determined that the operation mode of the high-voltage generator is the standby mode. In the standby mode, only the standby power module 220 is in operation; at this point, the standby power module 220 only provides power to a part of the circuits of the main control module 230, for example, only provides power to the status signal processing unit 231 in the main control module 230. The other parts in the main control module 230 other than the status signal processing unit 231 do not work, and the moving component power pack 240 and the imaging component power pack 250 do not work either.

In some embodiments, when the main control module 230 receives the half power-on signal, it can be determined that the operation mode of the high-voltage generator is the moving component power-on mode. In the moving component power-on mode, the standby power module 220, the main control module 230, and the moving component power pack 240 can be in operation. At this point, the status signal processing unit 231 controls the first switch 221 to be turned on, so that the standby power module 220 provides power to the entire main control module 230 through the first switch 221, and then the moving power modules in the moving component power pack 240, such as the first auxiliary power module 301 and the motor drive module 302, start to work. The first auxiliary power module 301 receives electrical energy from the power module group 210 to supply power to the FPGA board 312, and the motor drive module 30 receives electrical energy from the power module group 210 to supply power to the motor 314. The present disclosure is not limited to this.

In some embodiments, when the main control module 230 receives the full power-on signal and detects that residual charge of the battery pack 212 in the power module group 210 is less than a first threshold, it can be determined that the operation mode of the high-voltage generator is the low battery reminder mode. In this mode, it is generally necessary to stop normal operation of the mobile X-ray machine to avoid diagnosis error due to insufficient power of the power module group 210. Therefore, in the low battery reminder mode, generally only the standby power module 220, the main control module 230, and the moving component power pack 240 are in operation. In the moving component power pack 240, for example, the first auxiliary power module 301 and the motor drive module 302 are in working state. The moving component power pack 240 is in operation to facilitate the movement of the X-ray machine, for example, pushing the X-ray machine to a place where it can be charged so as to charge it in time. The present disclosure is not limited to this.

In some embodiments, when the main control module 230 receives the full power-on signal and detects that residual charge of the battery pack 212 in the power module group 210 is greater than or equal to the first threshold, it can be determined that the operation mode of the high-voltage generator is the imaging component power-on mode. In this mode, the residual charge of the battery pack 212 is enough and the X-ray machine can work normally, i.e. the X-ray machine can be ready for exposure at any time. Therefore, in the imaging component power-on mode, the standby power module 220, the main control module 230, the moving component power pack 240, and the imaging component power pack 250 are all in operation under the control of the main control module 230.

In some embodiments, in the standby mode, the status signal processing unit 231 is used to receive a first stage power-on signal. Only after receiving a first-stage power-on signal, a second-stage power-on signal will be received. A second-stage powering on is based on a first-stage powering on. Only after receiving the second-stage power-on signal, the sleep mode may be available, that is, the sleep mode is only available in the second-stage powering on. Wherein the first-stage power-on signal and the second-stage power-on signal may be a half power-on signal and a full power-on signal, respectively. The present disclosure does not limit this, but this is just one of the application methods.

Furthermore, in some embodiments, when the main control module 230 receives the sleep signal and detects that residual charge of the battery pack 212 in the power module group 210 is greater than or equal to the first threshold, it can be determined that the operation mode of the high-voltage generator is the sleep mode. In the sleep mode, the standby power module 220 and the main control module 230 are in operation, and the moving component power pack 240 and a part of the image component power pack 250 are in operation under the control of the main control module 230. In the sleep mode, it is generally necessary to ensure that the X-ray machine can move, so the moving component power pack 250 works normally. Parts of the imaging component power packs, such as the second auxiliary power module 311, can work normally to provide power to the PC 313. The power modules for specific work can be set according to actual needs, and the present disclosure does not limit this.

When the battery pack is in the charging state, the operation mode of the high-voltage generator is determined according to the action signal.

In some embodiments, when the main control module 230 receives the shutdown signal, it can be determined that the operation mode of the high-voltage generator is the charging standby mode. Generally, in the charging standby mode, the standby power module 220 and the main control module 230 are all in operation. Compared with the standby mode in which the battery pack is in the non-charging state, the charging standby mode can completely start up the main control module 230 at this point. Because the battery pack is charged, the supply power requirement of the power system can be guaranteed, so there is no need to only start up parts of the main control module 230 to save electrical energy. Furthermore, at this point, the detection unit 233 of the main control module 230 can detect the charging state of the power module group 110.

In some embodiments, when the main control module 230 receives the half power-on signal, it can be determined that the operation mode of the high-voltage generator is the charging power-on mode. In the charging power-on mode, the standby power module 220, the main control module 230, and a part of the moving component power pack 240 are in operation. For example, the first auxiliary power module 301 in the moving component power pack 240 can work to supply power to the FPGA board 312. Generally, at this point, the motor drive module 302 does not work, because the battery pack in the power module group is in a charging state, and it is necessary to ensure that the mobile X-ray machine will not be moved by mistake during the charging process in which the battery pack 212 is connected to the grid.

In some embodiments, when the main control module 230 receives the full power-on signal and detects that residual charge of the battery pack 212 in the power module group 210 is less than a second threshold, it can be determined that the operation mode of the high-voltage generator is the derating exposure mode. In the derating exposure mode, the standby power module 220, the main control module 230, a part of the moving component power pack 240, and the imaging component power pack 250 are in operation. Similarly, the motor driving module 302 generally does not work, because the battery pack in the power module group 210 is in a charging state at this time, and it is necessary to ensure that the mobile X-ray machine is not moved by mistake during the charging process in which the battery pack 212 is connected to the grid. Furthermore, in this mode, the imaging component power pack 250 works normally. When the residual charge of battery power of the mobile X-ray machine is low and the user is eager to use it, the mobile X-ray machine can work for conventional X-ray diagnosis while the battery pack 212 is charged, but the output power of the X-ray machine will be limited.

In some embodiments, when the main control module 230 receives the full power-on signal and detects that residual charge of the battery pack 212 in the power module group 210 is greater than or equal to the second threshold, it can be determined that the operation mode of the high-voltage generator is the imaging component power-on mode. This mode is basically same as the imaging component power-on mode when the battery pack 212 is in the non-charged state. The standby power module 220, the main control module 230, a part of the moving component power pack 240, and the imaging component power pack 250 all work normally. However, since the battery pack 212 in the power module group 210 is in the charging state, it is necessary to ensure that the mobile X-ray machine is not moved by mistake during the charging process in which the battery pack 212 is connected to the grid. Therefore, the motor drive module 302 in the moving component power pack 240 generally does not work.

In some embodiments, when the main control module 230 receives the sleep signal, it is determined that the operation mode of the high-voltage generator is the sleep mode. Similarly, when the battery pack 212 is charged and when the battery pack 212 is not charged, the sleep mode is substantially same. At this point, the standby power module 220 and the main control module 230 are in operation, and a part of the moving component power pack 240 and a part of the imaging component power pack 250 can be in operation under the control of the main control module 230. For example, the first auxiliary power module 301 in the moving component power pack 240 receives electrical energy from the power module group 210 to provide power to the FPGA board 312, and the second auxiliary power module 311 in the imaging component power pack 250 can work normally to provide power to the PC 313. The specific power modules for work is not limited to this. In some embodiments, since the battery pack 212 in the power module group 210 is in a charging state, it is also necessary to ensure that the mobile X-ray machine is not moved by mistake during the charging process in which the battery pack 212 is connected to the grid. Therefore, the motor drive module 302 in the moving component power pack 240 generally does not work.

In some embodiments, the first threshold and the second threshold may be equal; further, in some embodiments, the first threshold and the second threshold may be set to 2%-50% of the rated charge of the battery pack 212 when it is fully charged.

Figure 4:
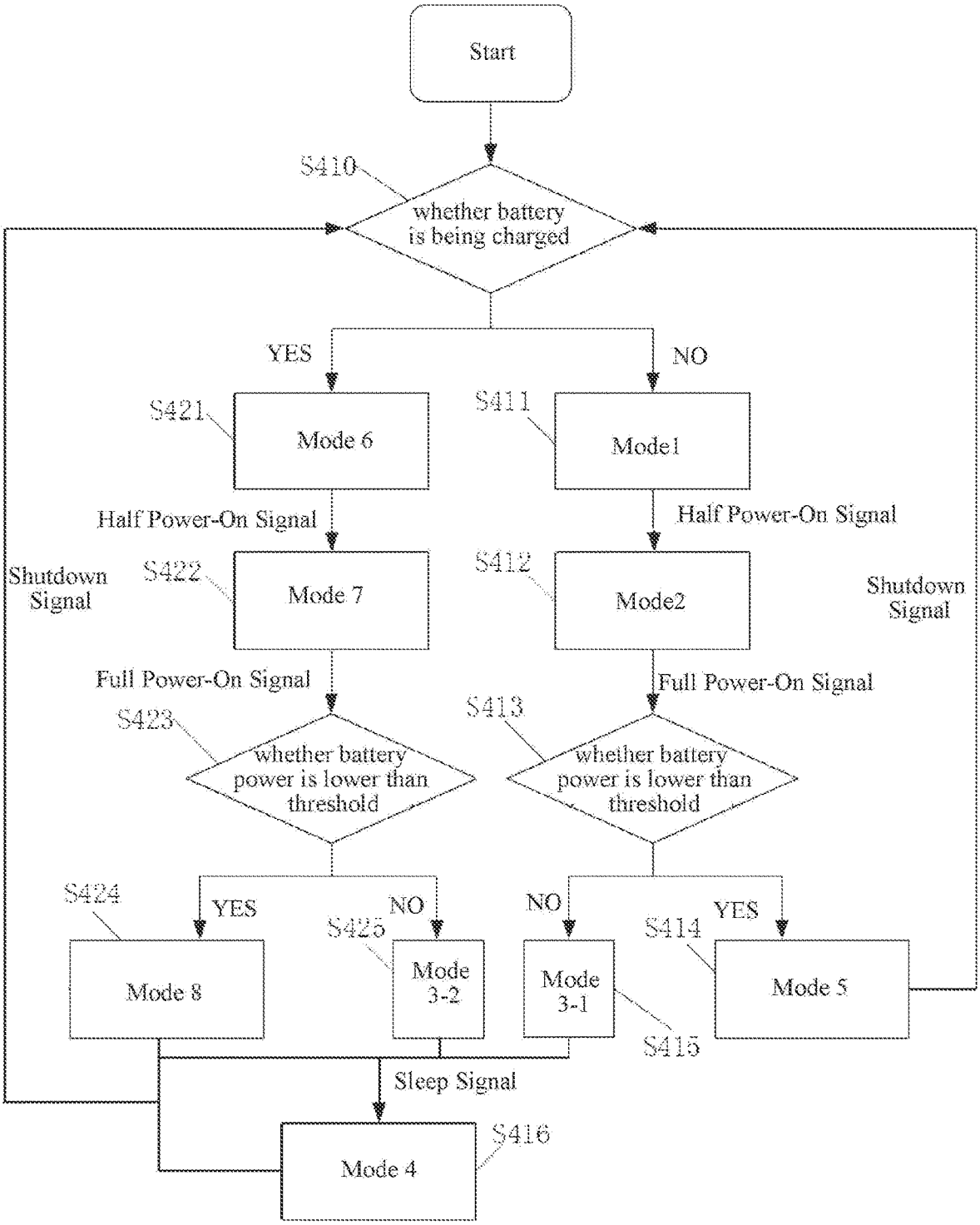
FIG. 4 shows a schematic flowchart of a power management scheme of a mobile X-ray machine according to an embodiment of the present disclosure.

As shown in FIG. 4, the power management system of the mobile X-ray machine will adjust the operation mode according to the status information of the power module group, making the power management more scientific.

For example, as shown in FIG. 4, Mode 1 to Mode 5 are operating modes when the battery pack 212 is in a non-charging state, and Mode 6 to Mode 8 are operating modes when the battery pack 212 is in a charging state. When the power management is performed by the power management system of the mobile X-ray machine, the control process and mode are as follows.

Step S410: determining whether the battery pack is being charged. If the battery pack is not being charged, step S411 is executed, if the battery pack is being charged, step S421 is executed.

In step S411, it is determined that the operation mode of the high-voltage generator is Mode 1, and Mode 1 is the standby mode. In the standby mode, the standby power module 220 is in a no-load operation, the status signal processing unit 231 in the main control module 230 works, other parts of the main control module 230 do not work, and the moving component power pack 240 and the imaging component power pack 250 do not work. At this point, the mobile X-ray machine may be in a shutdown state. When the mobile X-ray machine is shutdown, only the standby power module 220 and the status signal processing unit 231 work with little loss, which can greatly reduce the standby loss of the system.

Furthermore, when the high-voltage generator is in Mode 1, if the action signal received by the main control module 230 at this point is the half power-on signal, step S412 is executed.

In step S412, it is determined that the operation mode of the high-voltage generator is Mode 2, which is the moving component power-on mode. In this mode, the control signal generating unit 232 in the main control module 230 will generate a control signal to start up the moving component power pack 240, so that the motor drive module 302 and other function moving power modules (power modules 1~n) can work. At this time, the mobile X-ray machine is in a state in which it can be moved.

Further, when the high-voltage generator is in Mode 2, if the action signal received by the main control module 230 at this point is a full power-on signal, step S413 is executed.

In step S413, it is determined whether residual charge of the battery pack is lower than a first threshold. If the residual charge is lower than the first threshold, step S414 is executed. If the residual charge is greater than or equal to the first threshold, S415 is executed.

In step S414, it is determined that the operation mode of the high-voltage generator is Mode 5, which is the low battery reminder mode. In the low battery reminder mode, only the motor drive module 302 works. At this time, residual charge of the battery pack in the mobile X-ray machine is insufficient and the battery pack 212 needs to be charged in time. In this mode, the power supply modules related to motion function of the mobile X-ray machine in the moving component power pack 240 are kept in operation. i.e., being started up. It also prompts to user that the battery pack is insufficient, which is convenient for the user to move the mobile X-ray machine to charge.

Further, in Mode 5, if the main control module 230 receives the shutdown signal, step S410 is executed.

In step S415, it is determined that the operation mode of the high-voltage generator is Mode 3-1, which is an imaging component power-on mode with non-charging process. In this mode, the control signal generating unit 232 in the main control module 230 generates a control signal to start up the imaging component power pack 250, so that the function imaging power modules (power modules a~N) related to X-ray imaging work. At this time, the mobile X-ray machine can be moved and X-ray diagnosis can be performed normally. Herein, the Mode 3-1 and the Mode 3-2 below are both imaging component power-on mode. For example. Mode 3-1 is the imaging component power-on mode with charging process (i.e., the battery pack 212 is not connected with the grid) and Mode 3-2 is the imaging component power-on mode with non-charging process (i.e., the battery pack 212 is connected with the grid).

Further, in the Mode 3-1, if the main control module 230 receives a sleep signal at this time, step S416 is executed, and if a shutdown signal is received, step S410 is executed.

In step S416, it is determined that the operation mode of the high-voltage generator is Mode 4, which is the sleep mode, and the power modules related to the X-ray imaging can be shunt down. At this time, the mobile X-ray machine is in the sleep state. In addition, when the mobile X-ray machine is in the full power-on state and has not been used for a long time, it will also enter the sleep mode, and the control signal generating unit 232 in the main control module 230 will also generate control signal to shut down one or more power modules in the imaging component power pack 250 which are allowed to be shutdown. Similarly, in Mode 4, if the main control module 230 receives the shutdown signal at this time, step S410 is executed.

Furthermore, for step S421, it is determined that the operation mode of the high-voltage generator is Mode 6, and Mode 6 is the charging standby mode. This mode starts up the total main control module 230 compared to Mode 1, so that the standby power module 220 and the main control module 230 work normally at the same time. At this point, the main control module 230 can detect the charging state of the power module group 210.

In the charging standby mode, there is no need to save power, and the standby power module 220 and the main control module 230 can all be in operation.

When the high-voltage generator is in Mode 6, if the action signal received by the main control module 230 is a half power-on signal at this time, step S422 is executed.

In step S422, it is determined that the operation mode of the high-voltage generator is Mode 7, and Mode 7 is the charging power-on mode, which is similar to Mode 2. However, in Mode 7, the mobile X-ray machine is in a charging state and cannot be moved around because the battery pack is connected to grid. Therefore, in this mode, the power modules related to the movement of the moving component power pack 240 will not work to ensure that the mobile X-ray machine is not moved by mistake during the charging process in which the battery pack 212 is connected to the grid.

When the high-voltage generator is in Mode 7, if the action signal received by the main control module 230 is a full power-on signal at this point, step S423 is executed.

In step S423, it is determined whether the residual charge of the battery pack is lower than the second threshold. If the residual charge of the battery pack 212 is lower than the second threshold, step S424 is executed. If the residual charge of the battery pack 212 is not lower than the second threshold, step S425 is executed, that is, being in Mode 3-2.

In step S424, it is determined that the operation mode of the high-voltage generator is Mode 8, which is the derating exposure mode, which is similar to Mode 3-1 and Mode 3-2, but the output power of the high voltage generator is limited. At this point, the mobile X-ray machine cannot perform high-dose X-ray diagnosis, but it can meet the daily ordinary diagnosis requirements. In this mode, when residual charge of the battery pack of the mobile X-ray machine is low and the user is eager to use it, regular X-ray diagnosis can be performed while charging.

Further, in Mode 8, if the main control module 230 receives the shutdown signal at this time, step S410 is executed. If the main control module 230 receives the sleep signal at this time, step S416 is executed to enter Mode 4 (that is, the sleep mode), and the power module related to the X-ray imaging is shut down. At this point, the mobile X-ray machine is in the sleep state.

In step S425, it is determined that the operation mode of the high-voltage generator is Mode 3-2, which is the imaging component power-on mode with charging process. In this mode, the control signal generating unit 232 in the main control module 230 generates a control signal to start up the imaging component power pack 250, so that the function imaging power modules (power modules a~N) related to X-ray imaging can work. At this point, the mobile X-ray machine cannot be moved around, but X-ray diagnosis can be performed normally. Wherein, the imaging component power pack 250 works, and the motor drive module 302 does not work to prevent the high-voltage generator from moving.

Furthermore, in Mode 3-2, if the main control module 230 receives a sleep signal at this time, step S416 is executed, and if a shutdown signal is received, step S410 is executed. In some embodiments. Mode 4 can also be divided into two modes according to whether the battery is being charged, such as a non-charging process sleep mode and a charging process sleep mode. The charging process sleep mode generally requires that the motor drive module 302 in the moving component power pack 250 does not work to prevent the high-voltage generator from moving.

Moreover, in the foregoing embodiment, except for Mode 1, all other modes can flexibly switch on or switch off each power module according to the different needs of mobile X-ray machines. In addition, in some embodiments, after receiving the shutdown signal in each mode, step S410 may be executed to enter the standby mode. For example, in some embodiments, S410 may be executed when the shutdown signal is received in Mode 2 and Mode 7.

Among the above modes, only Mode 1, Mode 2, Mode 3-1 and Mode 3-2 are necessary basic modes. Mode 5 generally also exists. Mode 4 is an optional mode. The power management system of the mobile X-ray machine determines whether to enter this mode according to whether it receives a sleep signal from the upper machine 260. Mode 6, Mode 7, and Mode 8 are all optional modes.

In the power management system of the mobile X-ray machine and its control method according to the embodiments of the present disclosure, a main control module is provided. The main control module controls the operation of the functional component power pack according to the action signal sent by the upper machine and the status information of the supply modules. Therefore, the scientificity, reliability and flexibility of power management can be improved and the power loss of the high-voltage generator is reduced.

After considering the specification and practicing the invention disclosed herein, those skilled in the art will easily think of other embodiments of the present disclosure. This application is intended to cover any variations, uses, or adaptive changes of the present disclosure. These variations, uses, or adaptive changes follow the general principles of the present disclosure and include common knowledge or conventional technical means in the technical field not disclosed by the present disclosure. The description and the embodiments are to be regarded as exemplary only, and the true scope and spirit of the present disclosure are pointed out by the following claims.

It should be understood that the present disclosure is not limited to the precise structure described above and shown in the drawings, and various modifications and changes can be made without departing from its scope. The scope of the present disclosure is only limited by the appended claims.

What is claimed is:

1. A power management system of a mobile X-ray machine, comprising:

a power module group;

a main control module being connected with an upper machine, and configured to receive an action signal sent by the upper machine, acquire status information of the power module group, and output a control signal;

a functional component power pack being connected with the power module group and the main control module, and is configured to convert electrical energy of the power module group according to the control signal and output converted energy to functional components;

wherein the main control module comprises a status signal processing unit, and the status signal processing unit is electrically connected with the upper machine and configured to receive the action signal sent by the upper machine; and the power management system further comprises:

a standby power module being connected with the power module group and the status signal processing unit, and configured to convert electrical energy of the power module group and supply the converted energy to the status signal processing unit; and the standby power module being electrically connected with the main control module through a first switch and configured to supply power to the main control module in the case of the first switch is turned on, wherein the first switch is turned on or tuned off under the control of the status signal processing unit; and the standby power module supplies power to the status signal processing unit in the case of the first switch is turned off.

2. The power management system according to claim 1, wherein the main control module comprises a control signal generating unit, wherein the status signal processing unit is configured to send the action signal to the control signal generating unit, and the control signal generating unit is configured to generate the control signal according to the action signal and output the control signal.

3. The power management system according to claim 2, wherein the functional component power pack comprises a moving component power pack and an imaging component power pack, wherein the moving component power pack is connected with the power module group and the main control module, and configured to convert electrical energy of the power module group according to the control signal output by the control signal generating unit and output a converted energy to a moving component;

the imaging component power pack is connected with the power module group and the main control module, and configured to convert electrical energy of the power module group according to the control signal output by the control signal generating unit and output a converted energy to an imaging component.

4. The power management system according to claim 3, wherein the moving component power pack comprises at least any one of the following moving power modules: a first auxiliary power module and a motor drive module.

5. The power management system according to claim 3, wherein the imaging component power pack comprises at least any one of the following imaging power modules:

an imaging auxiliary power module, a filament power module connected with the imaging auxiliary power module, and a high-voltage control module connected with the imaging auxiliary power module;

a capacitor charger, an energy storage capacitor module connected with the capacitor charger, a high-voltage conversion module connected with the energy storage capacitor module, an X-ray tube motor drive module connected with the energy storage capacitor module, an inverter connected to the energy storage capacitor module; and a second auxiliary power module.

6. The power management system according to claim 2, wherein the main control module further comprises a detection unit;

wherein, the detection unit is connected with the power module group and configured to detect the status information of the power module group and send the status information to the control signal generating unit; and the control signal generating unit is configured to generate the control signal according to the status information of the power module group and the action signal sent by the upper machine.

7. The power management system according to claim 1, wherein the status information of the power module group comprises battery charging status information, battery non-charging status information, battery power status information, and battery abnormal status information.

8. The power management system according to claim 1, wherein the action signal sent by the upper machine comprises a sleep signal, a full power-on signal, a half power-on signal, and a shut-down signal.

9. A control method for a power management system of a mobile X-ray machine, the power management system comprising: a power module group; a main control module being connected with an upper machine; and a functional component power pack being connected with the power module group and the main control module;

the control method comprising:

powering on the main control module according to an action signal sent by the upper machine; and generating a control signal according to the action signal sent by the upper machine, and controlling the functional component power pack to convert electrical energy of the power module group and output converted energy to functional components;

wherein the main control module comprises a status signal processing unit, and the status signal processing unit is electrically connected with the upper machine and configured to receive the action signal sent by the upper machine; and the power management system further comprises:

a standby power module being connected with the power module group and the status signal processing unit, and configured to convert electrical energy of the power module group and supply the converted energy to the status signal processing unit; and the standby power module being electrically connected with the main control module through a first switch and configured to supply power to the main control module in the case of the first switch is turned on, wherein the first switch is turned on or tuned off under the control of the status signal processing unit; and the standby power module supplies power to the status signal processing unit in the case of the first switch is turned off.

10. The control method according to claim 9, wherein the functional component power pack comprises a moving component power pack and an imaging component power pack;

wherein the method further comprises:

controlling the moving component power pack to convert electrical energy of the power module group and output a converted energy to a moving component;

controlling the imaging component power pack to convert electrical energy of the power module group and output a converted energy to an imaging component.

11. The control method of claim 10, further comprising:

detecting status information of the power module group and generating the control signal according to the status information of the power module group and the action signal sent by the upper machine.

12. The control method of claim 11, further comprising:

determining an operation mode of a high-voltage generator according to the status information of the power module group and the action signal; and generating the control signal according to the operating mode.

13. The control method according to claim 12, wherein the action signal comprises at least one of the following: a sleep signal, a full power-on signal, a half power-on signal, and a shut-down signal.

14. The control method according to claim 13, wherein the operation mode comprises at least one of the following: a standby mode, a moving component power-on mode, an imaging component power-on mode, a sleep mode, a low battery reminder mode, a charging standby mode, a charging power-on mode, and a derating exposure mode.

15. The control method according to claim 14, wherein the power module group comprises: a battery pack and a battery charger for charging the battery pack, and the status information of the power module group comprises: battery charging status information, battery non-charging status information, battery power status information, and battery abnormal status information.

16. The control method of claim 15, further comprising:

when the battery pack is in a non-charging state, determining the operation mode of the high-voltage generator according to the action signal; and determining that the operation mode of the high-voltage generator is the standby mode, in the case of the action signal is the shutdown signal;

determining that the operation mode of the high-voltage generator is the moving component power-on mode, in the case of the action signal is the half power-on signal;

determining that the operation mode of the high-voltage generator is the low battery reminder mode, in the case of the action signal is the full power-on signal and residual charge of the battery pack is less than a first threshold;

determining that the operation mode of the high-voltage generator is the imaging component power-on mode, in the case of the action signal is the full power-on signal and residual charge of the battery pack is greater than or equal to the first threshold;

determining that the operation mode of the high-voltage generator is the sleep mode, in the case of the action signal is the sleep signal and residual charge of the battery pack is greater than or equal to the first threshold.

17. The control method of claim 16, wherein, in the standby mode, putting the standby power module into operation;

in the moving component power-on mode, putting the standby power module, the main control module and the moving component power pack into operation;

in the low battery reminder mode, putting the standby power module, the main control module and the moving component power pack into operation;

in the imaging component power-on mode, putting the standby power module, the main control module, the moving component power pack and the imaging component power pack into operation;

in the sleep mode, putting the standby power module, the main control module, the moving component power pack and a part of the imaging component power pack into operation.

18. The control method according to claim 16, wherein, when the battery pack is in a charging state, determining the operation mode of the high-voltage generator according to the action signal; and determining that the operation mode of the high-voltage generator is the charging standby mode, in the case of the action signal is the shutdown signal;

determining that the operation mode of the high-voltage generator is the charging power-on mode, in the case of the action signal is the half power-on signal;

determining that the operation mode of the high-voltage generator is the derating exposure mode, in the case of the action signal is the full power-on signal and battery power of the power module group is less than a second threshold;

determining that the operation mode of the high-voltage generator is the imaging component power-on mode, in the case of the action signal is the full power-on signal and battery power of the power module group is greater than or equal to the second threshold;

determining that the operation mode of the high-voltage generator is the sleep mode, in the case of the action signal is the sleep signal.

19. The control method according to claim 18, wherein, in the standby mode, putting the standby power module and the main control module into operation;

in the charging power-on mode, putting the standby power module, the main control module and a part of the moving component power pack into operation;

in the derating exposure mode, putting the standby power module, the main control module, a part of the moving component power pack and the imaging component power pack into operation;

in the imaging component power-on mode, putting the standby power module, the main control module, a part of the moving component power pack and the imaging component power pack into operation;

in the sleep mode, putting the standby power, the main control module, a part of the moving component power pack and a part of the imaging component power pack into operation.

* * * * *